US005785428A

United States Patent [19]

Mazzocchi

[11] Patent Number: 5,785,428

[45] Date of Patent: Jul. 28, 1998

[54] BAG FOR STORING AND WASHING PRODUCE

[75] Inventor: Randolph A. Mazzocchi, Greenville, Wis.

[73] Assignee: Reynolds Consumer Products, Inc., Appleton, Wis.

[21] Appl. No.: 766,255

[22] Filed: Dec. 13, 1996

[51] Int. Cl.[6] ..... B65D 33/01

[52] U.S. Cl. ..... 383/103; 383/63; 383/67; 383/104; 383/209

[58] Field of Search ..... 383/38, 40, 67, 383/210, 211, 100, 103, 104, 207, 209, 63

[56] References Cited

U.S. PATENT DOCUMENTS

| | | | |
|---|---|---|---|
| 383,327 | 5/1888 | Starr . | |
| 2,001,149 | 5/1935 | Monschein . | |
| 2,163,324 | 6/1939 | Reinhold . | |
| 2,688,914 | 9/1954 | Eckler | 383/103 X |
| 3,159,096 | 12/1964 | Tocker . | |
| 3,229,813 | 1/1966 | Crowe, Jr. et al. . | |
| 3,934,999 | 1/1976 | Meier . | |
| 4,576,316 | 3/1986 | Foster . | |
| 4,741,909 | 5/1988 | Guthrie . | |
| 5,059,036 | 10/1991 | Richison et al. . | |
| 5,380,093 | 1/1995 | Goldman | 383/100 X |
| 5,492,705 | 2/1996 | Porchia et al. . | |

FOREIGN PATENT DOCUMENTS

| | | | |
|---|---|---|---|
| 230565 | 12/1963 | Austria | 383/103 |
| 275350 | 7/1988 | European Pat. Off. | 383/38 |
| 1170658 | 1/1959 | France | 383/38 |

*Primary Examiner*—Jes F. Pascua
*Attorney, Agent, or Firm*—Alan T. McDonald

[57] ABSTRACT

A disposable bag having a gusset containing drainage holes positioned at the bottom of the disposable bag for storing and washing produce is provided. The disposable bag includes a removable seal positioned proximate the gusset and configured to prevent the flow of liquids through the drainage holes in the gusset before the seal is removed. The gusset permits the bag to stand in an upright position while washing or rinsing produce contained within the bag.

10 Claims, 5 Drawing Sheets

BAG FOR STORING AND WASHING PRODUCE

FIELD OF THE INVENTION

The present invention relates to a method and apparatus for storing and cleaning produce in a disposable bag. More particularly, the invention relates to a disposable bag having a gusset containing drainage holes for permitting the escape of water when washing produce within the bag.

BACKGROUND

Before eating produce, such as lettuce or carrots, the produce is often rinsed in water. Traditionally, produce is rinsed in strainers or colanders, which are bowl-shaped kitchen utensils used for draining off liquids and rinsing food. Although strainers and colanders are useful utensils, they pose a number of disadvantages. First, when using a colander, additional dishes are dirtied, increasing the amount of cleanup required. Second, a variety of produce is sometimes cleaned for one meal and therefore requires more than one colander. For example, a person preparing a dinner including fresh-cut strawberries, steamed carrots, and a lettuce salad would likely prefer to rinse each of these fruits and vegetables individually in separate colanders. While the produce could be rinsed together, it would be both time-consuming and difficult to separate the strawberries, carrots, and lettuce from each other once they have become intermixed. In addition, it is likely that some of the carrots would remain with the strawberries, and some of the strawberries would remain with the carrots, both of which may be undesirable combinations. A person could wash each of these vegetables one after another in a single colander, but this too poses problems because sufficient water may not drain from the produce for a few minutes. These delays create an undesirable wait in preparing the meal.

Alternatively, produce is sometimes washed, e.g., it is cooked, while it is still contained within a conventional thermoplastic bag. Such bags contain no holes other than a top opening. Unfortunately, washing in this manner is undesirable because the produce is very difficult to drain. The water can be poured off from the top opening, but this task is tedious because many types of produce float in water and thus easily flow out through the top of a conventional bag when draining. Also, conventional bags do not readily stand upright and thus are likely to tip over and spill both produce and water during the preparation process.

Other bags are known that contain perforations along the side walls. These bags also pose significant problems. Water can often escape from all sides of the bag. It is thus difficult to direct the escape of water into a sink or catch-basin. If substantial quantities of water are allowed to exit the upper portion and sides of the bag, the lower-lying produce is washed less thoroughly. Like conventional bags, these bags do not stand upright and are prone to spilling. Also, the holes in the bag are always open to the outside environment. This feature is not always desirable.

In addition, produce is increasingly sold in prepared packages containing partially processed produce, such as fresh salad ingredients, sliced carrots, grapes, etc. These packages emphasize ease of use and preparation, and appeal to busy consumers wishing to maintain a healthy diet. While the produce sold in these packages is typically in a "ready to eat" state free of excess stems, dirt, and waste, consumers often desire to wash the produce further in order to ensure it is clean. It is therefore desirable that the produce be washed as simply and quickly as possible. It is also desirable that this produce be washed with as little mess and inconvenience as possible, preferably without removing the produce from the package.

Consequently, a need exists for a method and apparatus for storing and washing produce that overcomes the aforementioned shortcomings associated with existing methods and apparatuses.

SUMMARY OF THE INVENTION

The present invention is directed to a disposable bag for storage and cleaning of produce. The disposable bag has at least one side wall, a top, and a bottom. An opening in the disposable bag is positioned proximate the top of the bag and is configured to provide an entry for produce. A zipper profile is included to provide a reclosable seal over the opening. The bottom of the bag is configured with a gusset having drainage holes sized to permit the passage of water through the gusset while preventing the passage of produce. A removable seal is integrally secured to the bag. This removable seal is configured and arranged to impede the passage of water through the drainage holes in the gusset while the seal is secured to the bag. The gusset is further configured to support the bag in an upright position when the seal is removed.

In one implementation, the removable seal is formed with perforations positioned proximate the bottom of the side wall. The perforations promote the removal of the seal. In certain implementations, the perforations are configured and arranged to permit passage of gasses or water vapor through the drainage holes before the seal is removed. In an alternative implementation, a tear bead is positioned proximate the bottom of the bag and also promotes the removal of the seal.

The disposable bag is used for storing and washing produce. Produce is placed within the disposable bag prior to removal of the removable seal. The zipper is closed in order to maintain freshness of the produce, and the produce is stored until use. Prior to use, the seal is removed from the bag in order to expose the perforated gusset. Water is then rinsed through the bag from the top and flows over the produce and out through the drainage holes in the gusset. The gusset allows the bag to remain in an upright position during washing of the produce. It also allows the bag to remain upright while excess water is draining from the produce.

The disposable bag is manufactured by providing a web having a first portion, a second portion, and an intermediate portion between the first and second portions. A reclosable zipper profile is secured to the web or integrally formed with the web, and the intermediate portion is perforated with drainage holes configured and arranged to permit the passage of water but not the passage of produce. The gusset is formed from the intermediate portion containing the drainage holes, the removable seal is formed from the gusset, and the film is cut to form a bag.

BRIEF DESCRIPTION OF THE DRAWINGS

Other aspects and advantages of the invention will become apparent upon reading the following Detailed Description and upon reference to the drawings in which.

Figure 1:
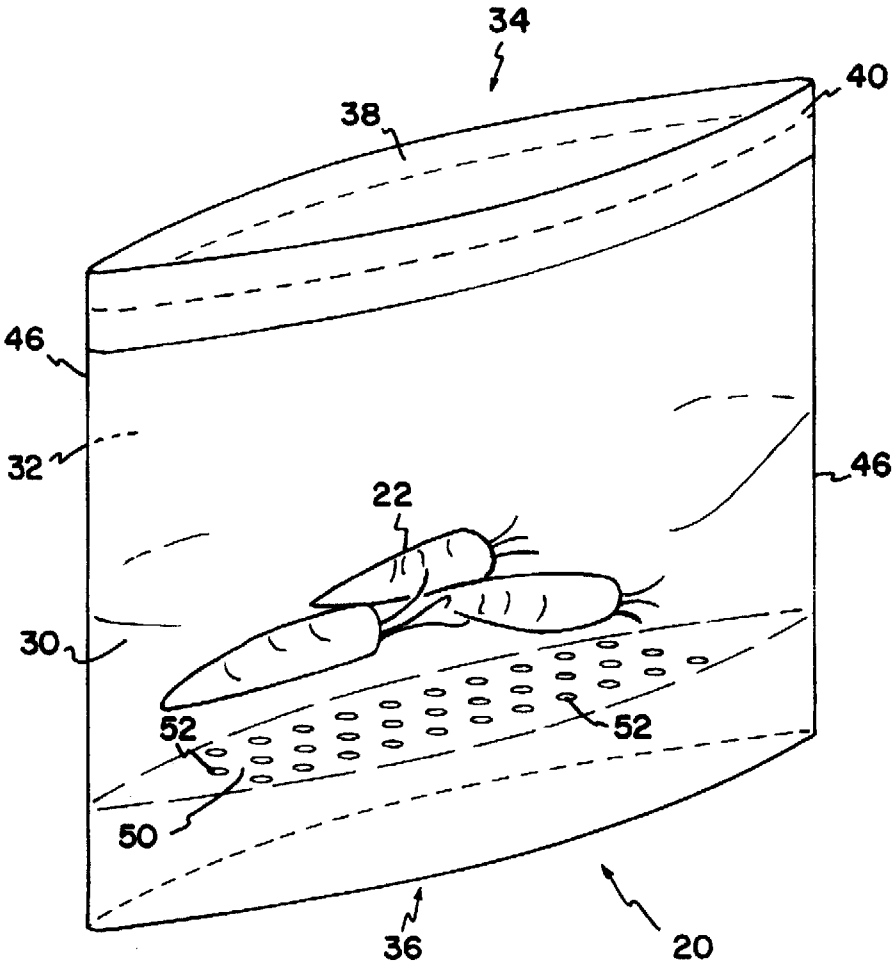
FIG. 1 is a perspective view of a disposable bag arranged and constructed in accordance with the present invention, showing produce within the bag and the removable seal removed from the bag.

While the invention is susceptible to various modifications and alternative forms, specifics thereof have been shown by way of example and drawings, and will be described in detail. It should be understood, however, that the intention is not to limit the invention to particular embodiments described. On the contrary, the intention is to cover modifications, equivalents, and alternatives falling within the spirit and scope of the invention as defined by the appended claims.

DETAILED DESCRIPTION

A disposable bag, constructed in accordance with the present invention, is shown generally in FIGS. 1 through 5 as 20. The disposable bag 20 is made of a thermoplastic material and includes a side wall 30, a zipper 40, a gusset 50, and a removable seal (60 on FIG. 3). An opening 38 is positioned proximate the top 34 of the bag 20 and includes the reclosable zipper 40. The zipper 40 permits repeated opening and closing of the disposable bag 20 in order to permit the insertion and removal of produce 22. Produce is envisioned by the inventor to include any materials or compositions which are rinsed or soaked in a liquid medium, such as fruit, vegetables, grains, and pasta.

The gusset 50 is positioned at the bottom of the bag 20. The gusset 50 includes drainage holes 52 permitting the passage of water through the gusset 50. The drainage holes 52 are large enough to permit the passage of water through them but are small enough to prevent the passage of the produce 20.

Figure 3:
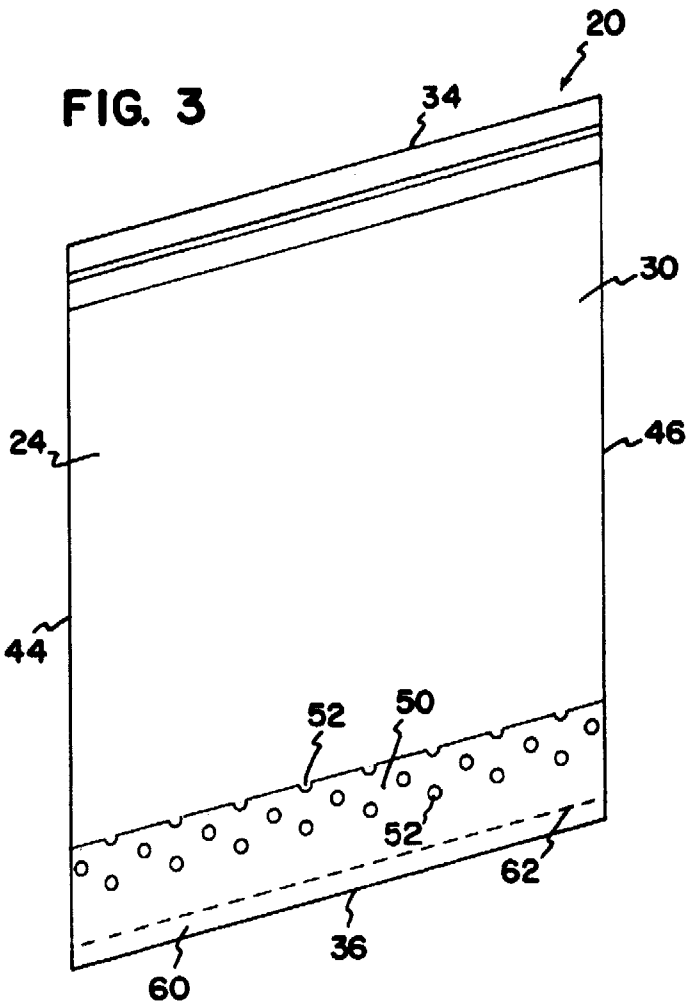
FIG. 3 is a frontal view of a disposable bag arranged and constructed in accordance with the present invention, showing the removable seal intact.
Figure 4:
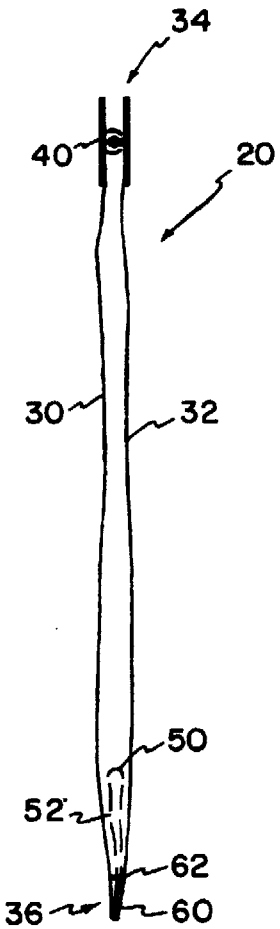
FIG. 4 is a cross-sectional view of the disposable bag shown in FIG. 3.

As shown in FIGS. 3 and 4, the removable seal 60 is integrally secured to the bag 20 proximate the gusset 50. The seal 60 extends over the gusset 50 so that the passage of water through the drainage holes 52 in the gusset 50 is impeded while the seal 60 is secured to the bag 20. The gusset 50 extends into the inside 24 of the bag 20 while the seal 60 is attached. Once the seal 60 is removed from the bag 20, the bottom 36 of the bag 20 may billow out to unfold and expose the gusset 50.

Figure 2:
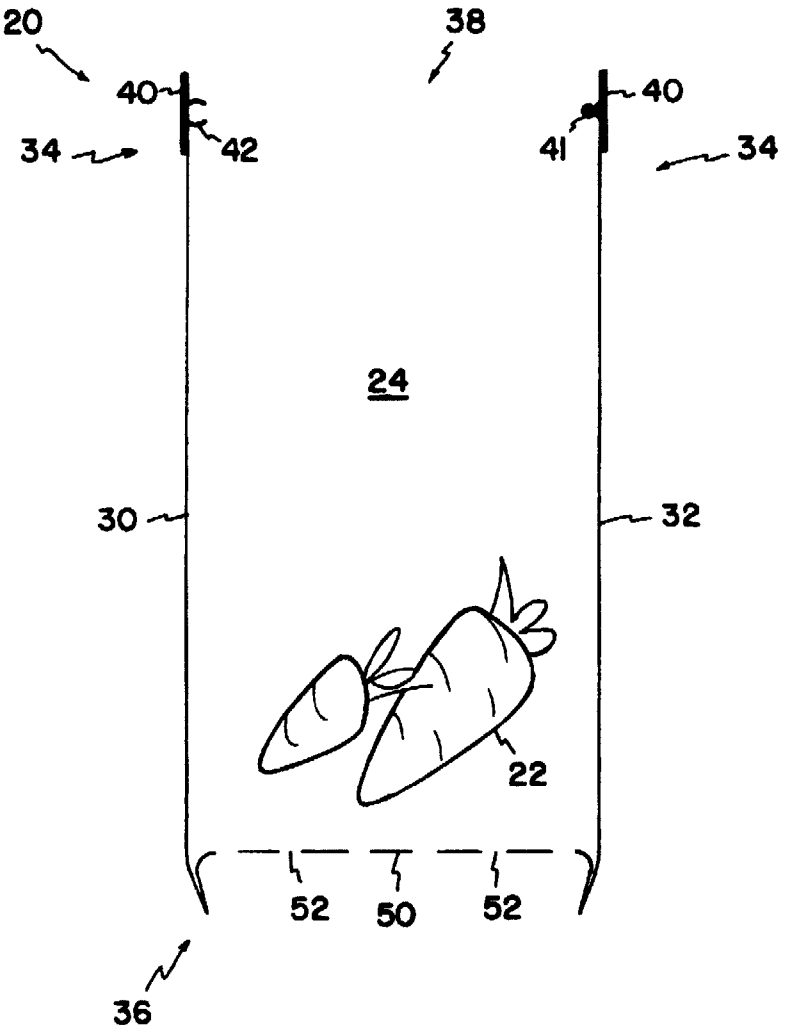
FIG. 2 is a cross-sectional view of the disposable bag shown in FIG. 1.
Figure 5:
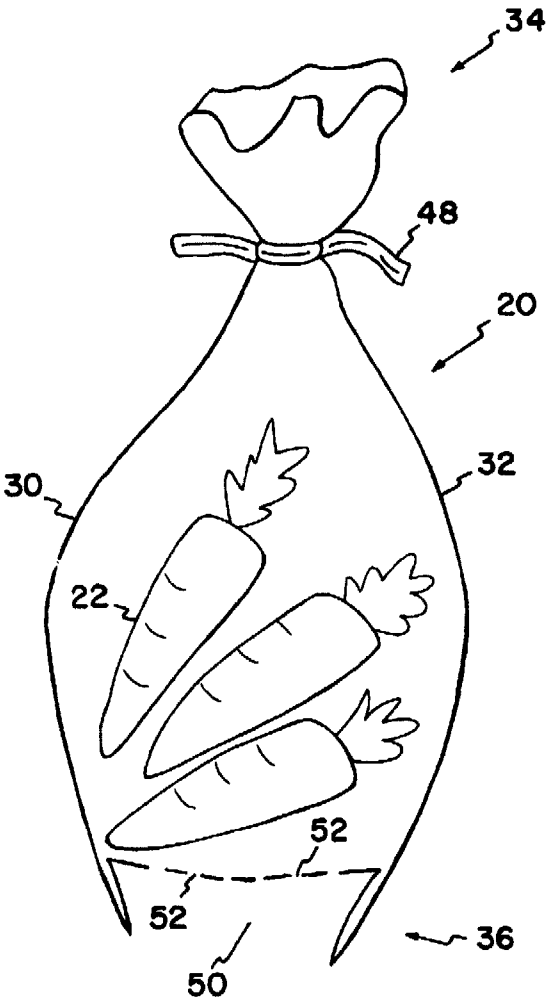
FIG. 5 is a cross-sectional view of a disposable bag arranged and constructed in accordance with the present invention, showing a twist-tie closure.
Figure 6:
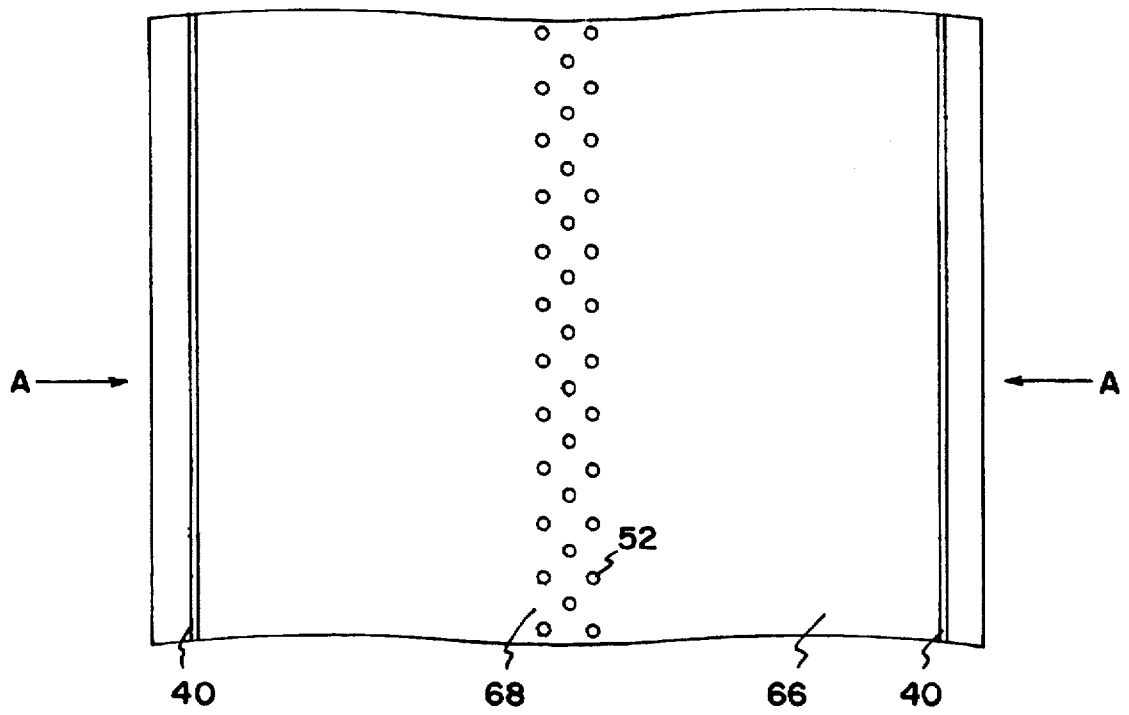
FIG. 6 is a fragmentary elevational view of a perforated thermoplastic web in accordance with the present invention.

Upon removal of the seal 60 and unfolding the gusset 50, as shown in FIGS. 2 and 5, the bottom 36 of the bag 20 becomes wide enough to support the bag 20 to remain in an upright position. Produce 22 can then be washed in the same way as a person would use a colander. Water or another cleaning solution, such as a disinfectant or soap solution, may be poured into the opening 38 of the bag 20, or the bag 20 may be held beneath a tap-water faucet. The produce 22 can be hand washed by individually cleaning each piece, or all of the produce 22 may be washed together. The bag 20 containing produce 22 may also be immersed and soaked in a sink, bowl, or other basin containing water. Upon completion of washing, the bag 20 and produce 22 may be lifted from the water and permitted to drain. If the water readily runs off the produce 22, the bag 20 may be held over the sink while draining. Alternatively, the bag 20 is set upon a surface and allowed to gradually drain. For produce 22 that is likely to retain undrained water, such as lettuce, the bag 20 may be resealed at the zipper 40 and gently shaken to release additional water through the gusset 50 positioned near the bottom 36 of the bag 20.

Figure 7:
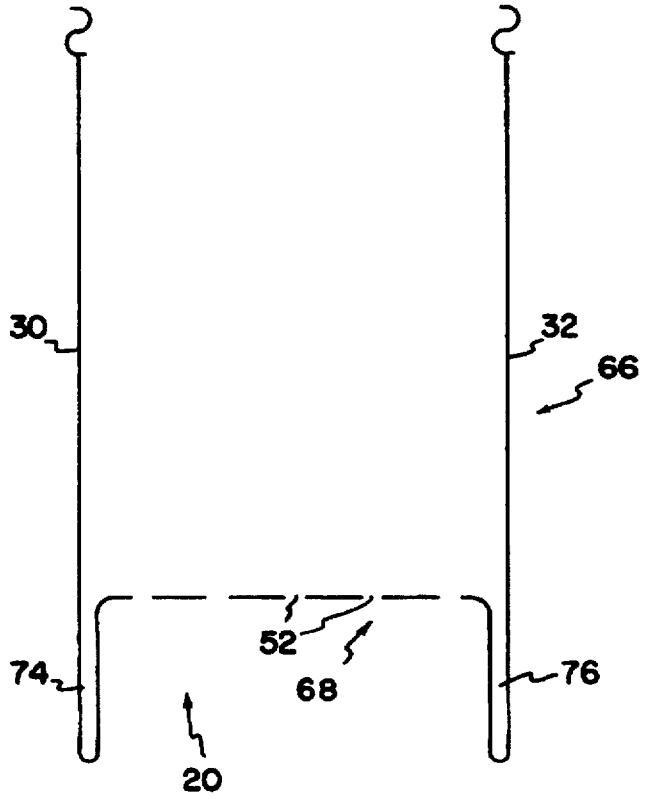
FIG. 7 is a cross-sectional view of a perforated thermoplastic web in accordance with the present invention, showing the web folded to form a gusset.
Figure 9A:
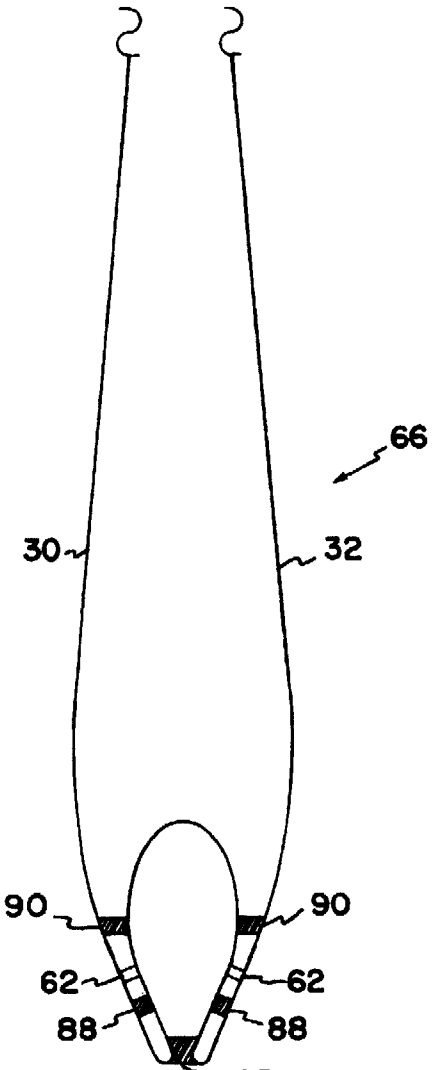
FIGS. 9 and 9A are a cross-sectional views of a perforated thermoplastic web in accordance with the present invention, showing the removable seal formed in the web.
Figure 9:
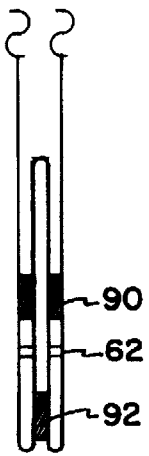
Figure 8A:
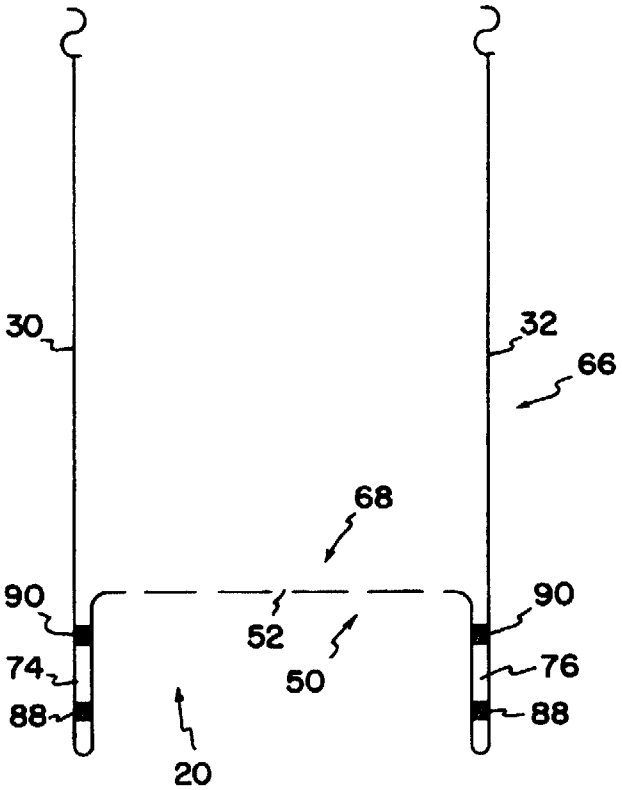
FIGS. 8 and 8A are a cross-sectional views of a perforated thermoplastic web in accordance with the present invention, showing the web folded and heat-sealed.
Figure 8:
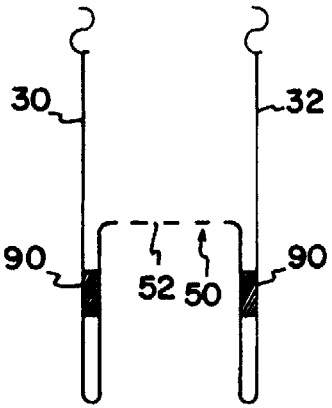

As shown in FIGS. 1 and 2, the gusset 50 extends substantially across the bottom 36 of the bag 20 when produce 22 is positioned within the bag 20. While the gusset 50 is located proximate the bottom 36 of the bag 20, it may include tabs 74, 76 extending below the gusset 50, as shown in FIG. 7. As shown in FIGS. 3 and 4, prior to removal of the seal 60, the gusset 50 extends internally into the bag 20. The gusset 50 may fold over onto itself once or more than once inside the bag 20.

The drainage holes 52 in the gusset 50 are large enough to allow the passage of water but small enough to prevent the passage of produce 22. Undesirable small waste particles, such as soil, bits of vegetative and mineral matter, and small seeds may pass through the drainage holes 52. The drainage holes 52 may be of a plurality of shapes and sizes, and may be distributed evenly across the gusset 50 or with a varying density.

Depending upon the intended use of the bag 20, the drainage holes 52 in the gusset 50 are formed of different sizes. When the disposable bag 20 is intended to wash only large produce, such as whole carrots, tomatoes, or apples, the drainage holes 52 may be relatively large. When the disposable bag 20 is intended to wash small produce, such as peas, blue berries, or raspberries, the drainage holes 52 may be relatively small. The diameter of the drainage holes may be between approximately 0.5 and 2.5 millimeters, and more specifically between 1.0 and 1.5 millimeters. The surface area of each drainage hole 52 may be approximately 0.2 to 5.0 square millimeters.

As shown in FIG. 2, the zipper 40 includes both a male profile 41 and a female profile 42. The male profile 41 is configured with an extended head portion which inserts into, and locks with, the female profile 42 in order to provide a substantially air-tight seal. In other implementations of the present invention, the zipper 40 may include additional profile elements that enhance the locking properties between the male profile 41 and female profile 42. The reclosable zipper 40 may further include a seal joining the male profile 41 to the female profile 42 for creating a tamper-resistant package in which produce is sold in stores. The seal joining the male profile 41 and female profile 42 may include a tear bead or perforations for ease in opening removing the seal to gain access to the contents of the bag 20. A hook-hole or holes for displaying the bag 20 and its contents in a store display may also be included in the zipper 40.

Figure 10:
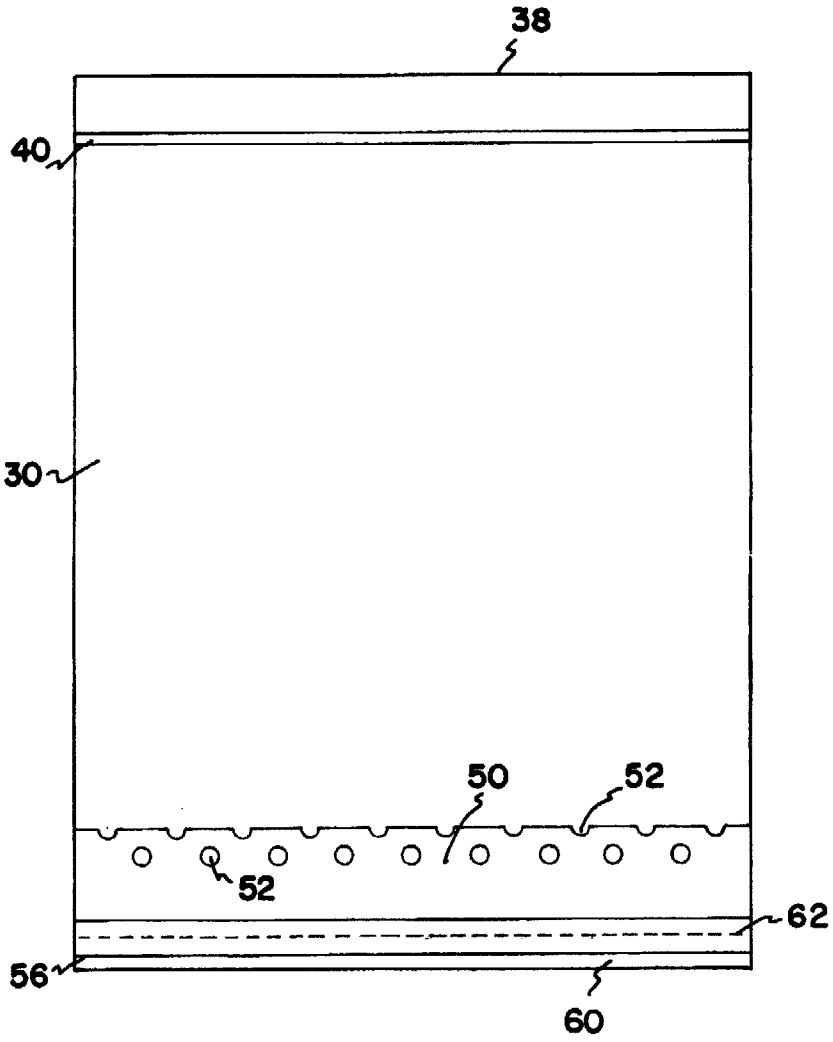
FIG. 10 is a frontal view of a disposable bag arranged and constructed in accordance with the present invention, showing the removable seal intact.

In one implementation of the invention, as shown in FIG. 10, the removable seal 60 is integrally formed from the same material used to form the gusset 50 and side wall 30. In this implementation, the removable seal 60 includes a heat-fused portion 56 of the bag 20, as shown in FIG. 10. The heat-fused portion 56 joins the bottom 36 of the first wall 30 and second wall 32 together and retains the gusset 50 in the inside 24 of the bag 20. Before removal of the seal 60, the first wall 30 and second wall 32 remain fused to each other at the bottom 36 of the bag 22. When the seal 60 is removed, the bottom 36 of the bag 22 spreads out so that the bottom of the first wall 30 and the bottom of the second wall 32 separate from one another, and the gusset 50 unfolds between the two walls 30, 32.

As shown in FIG. 10, in one implementation of the present invention, the removable seal 60 includes a series of perforations 62 positioned along the bottom 36 of the side walls 30, 32. The perforations 62 provide a weak spot in the seal 60 which allows controlled tearing along the perforations 62 to remove the seal 60 and expose the gusset 50.

Figure 11:
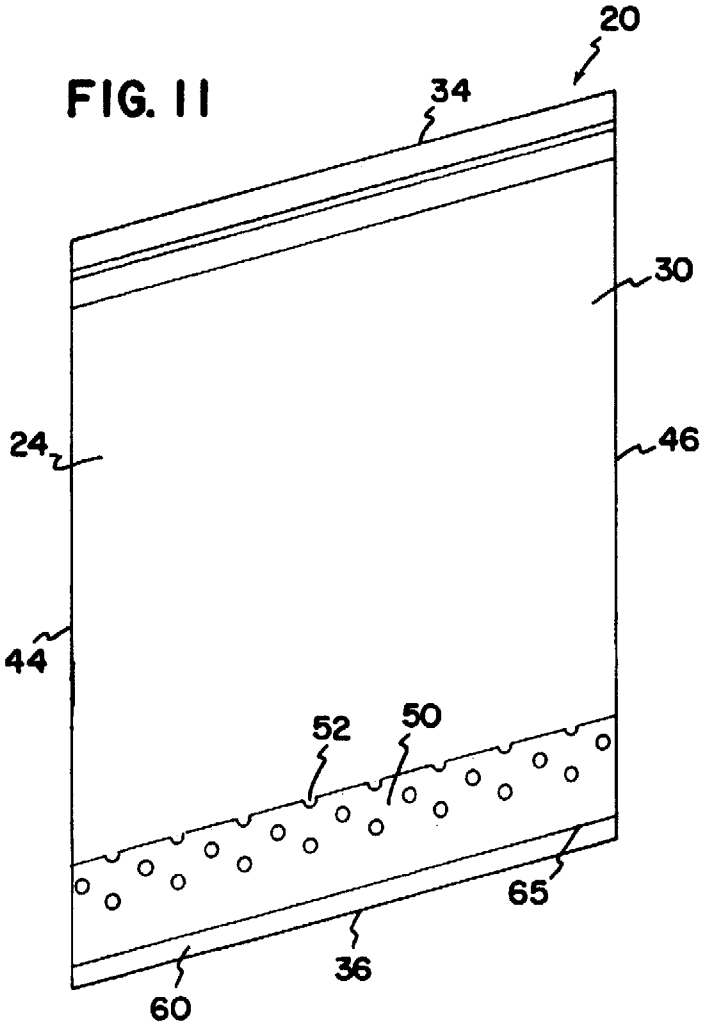
FIG. 11 is a frontal view of a disposable bag arranged and constructed in accordance with the present invention, showing a tear bead proximate the removable seal.

In an alternative implementation of the present invention, shown in FIG. 11, the removable seal 60 includes a tear bead 65. The tear bead 65 consists of a flexible element positioned within the seal 60 and designed to tear the thermoplastic material forming the seal 60, thus gaining access to the gusset 50.

The bag 20 may be purchased by consumers either empty or with produce prepackaged within the bag. In the case of empty bags 20 purchased by the consumer, the bags 20 may be of a number of different sizes suitable for various home or commercial uses. Small disposable bags 20 suitable for individual servings are envisioned, as are larger bags 20 containing sufficient space for bulky produce 22 such as lettuce or great quantities of produce 22. In the case of prepackaged produce 22, the bags 20 may be formed at a commercial processing facility and have the fruits or vegetables placed directly into the bags as the bags 20 are formed. Alternatively, the bags 20 may be provided to a commercial processor, which fills them at a produce processing facility.

In another implementation, as shown in FIGS. 6 through 9A, the bag 20 is manufactured from a thermoplastic web 66. The thermoplastic web 66 may be, for example, polyethylene. The thermoplastic web 66 is pierced by drainage holes 52 which penetrate the gusset 50. The drainage holes 52 are typically formed with a hot needle perforator. As shown in FIGS. 7, 8, 8A, 9, and 9A, the zipper 40 is also affixed to the web 66, typically with the male profile 41 secured to one edge of the web 66 and the female profile 42 secured to the opposite edge of the web 66. An intermediate portion 68 of the web 66 is folded to form the gusset 20, the web 66 is sealed to form the removable seal, and the bag 20 is formed.

While the present invention has been described with reference to several particular implementations, those skilled in the art will recognize that many changes may be made hereto without departing from the spirit and scope of the present invention.

I claim:

1. A disposable bag for storage and cleaning of produce, the disposable bag comprising:

at least one side wall, a top, and a bottom;

an opening proximate the top of the bag to provide an entry for produce to be stored or cleaned;

a zipper profile to provide a recloseable seal for the opening;

a gusset located at the bottom of the bag to support the bag in an upright position, and having drainage holes sized to permit the passage of water through the gusset while substantially preventing the passage of produce; a removable seal, integrally secured to the bag, to impede the passage of water through the drainage holes in the gusset while the seal is secured to the bag and perforations positioned proximate the bottom of the side wall to promote removal of the removable seal.

2. The disposable bag according to claim 1, wherein the perforations permit passage of gasses or water vapor through the perforations before the removable seal is removed.

3. The disposable bag according to claim 1, further comprising a tear bead positioned within the removable seal to promote removal of the removable seal from the bag.

4. The disposable bag according to claim 1, wherein the drainage holes in the gusset have a size of between 0.2 and 5.0 square millimeters.

5. The disposable bag according to claim 1, wherein the drainage holes in the gusset have an area of between 0.5 and 2.5 millimeters in diameter.

6. A disposable bag for storage and cleaning of produce, the disposable bag comprising:

a thermoplastic film forming at least one side wall, a top, a bottom, an inside, and an outside;

an opening proximate the top of the bag to provide an entry for produce to be stored or washed, the opening including a fastener for closing the bag;

a gusset located at the bottom of the bag, the gusset having drainage holes sized to permit the passage of water through the gusset while substantially preventing the passage of the produce through the gusset; and a removable seal, integrally secured to the bag, the removable seal retaining the gusset inside the bag before the seal is removed the gusset supporting the bag in an upright position when the produce is in the bag and after the removable seal has been removed.

7. The disposable bag according to claim 6, further comprising perforations positioned proximate the bottom of the bag, the perforations promoting removal of the removable seal.

8. The disposable bag according to claim 7, wherein the perforations permit passage of gasses or water vapor through the perforations before the seal is removed.

9. The disposable bag according to claim 6, further comprising a tear bead positioned within the removable seal to promote removal of the removable seal from the bag.

10. The disposable bag according to claim 6, wherein the drainage holes have a diameter of between 0.5 and 2.5 millimeters.

* * * * *